United States Patent [19]

Hildt

[11] 4,016,981

[45] Apr. 12, 1977

[54] HANGER STACKER FIXTURE

[76] Inventor: Earl H. Hildt, 2303 Tarleton Lane, Baltimore, Md. 21234

[22] Filed: Dec. 31, 1975

[21] Appl. No.: 645,603

[52] U.S. Cl. ..... 211/49 R

[51] Int. Cl.[2] ..... A47F 7/00

[58] Field of Search ..... 211/49 R, 13, 57, 58, 211/59; 248/346

[56] References Cited

UNITED STATES PATENTS

| | | | |
|---|---|---|---|
| 1,127,319 | 2/1915 | Thompson | 211/49 R |
| 1,225,952 | 5/1917 | Hamilton | 211/59 |
| 1,690,394 | 11/1928 | Belt | 211/49 R X |
| 2,621,807 | 12/1952 | Rendich | 211/49 R |
| 2,626,062 | 1/1953 | Manzella | 211/59 |
| 2,918,174 | 12/1959 | Tabbi | 211/49 R |
| 3,490,599 | 1/1970 | Von Maur | 211/49 R |

FOREIGN PATENTS OR APPLICATIONS

| | | | |
|---|---|---|---|
| 128,926 | 8/1950 | Sweden | 211/49 R |

*Primary Examiner*—Ramon S. Britts
*Assistant Examiner*—Robert W. Gibson, Jr.
*Attorney, Agent, or Firm*—J. Wesley Everett

[57] ABSTRACT

A rack for storing clothes hangers having a single neck portion and two shoulder portions wherein the rack comprises a base and a plurality of elongated posts extending upwardly and perpendicular to the upper surface of the base, two of the posts are spaced apart in the same plane to engage each side edge of the neck portion of the hanger, a third post is spaced outwardly from the plane embracing the first two mentioned posts and positioned centrally therebetween to engage the under edge of the neck portion of the hanger and a pair of spaced posts positioned in a plane parallel with the first mentioned plane and spaced outwardly from the third post adapted to engage the under side of the two shoulder portions of the hanger.

1 Claim, 2 Drawing Figures

HANGER STACKER FIXTURE

The invention relates to a rack for storing clothes hangers wherein the rack is provided with a neck portion and two shoulder portions.

The primary object of the invention is to provide a rack for storing clothes hangers when they are not in use.

Another object of the invention is to provide a clothes hanger rack that will accommodate one or more modified forms of hangers.

Still another object of the invention is to provide means by which the rack may be easily moved from place to place without interfering with the clothes hangers carried thereon.

While several objects of the invention have been fully pointed out, other objects, uses and advantages will be more apparent as the nature of the invention is more fully disclosed in the following detailed description with reference to the accompanying drawings, in which.

In referring to the drawings, like reference characters are used to designate like and similar parts throughout the several views.

Figure 1:
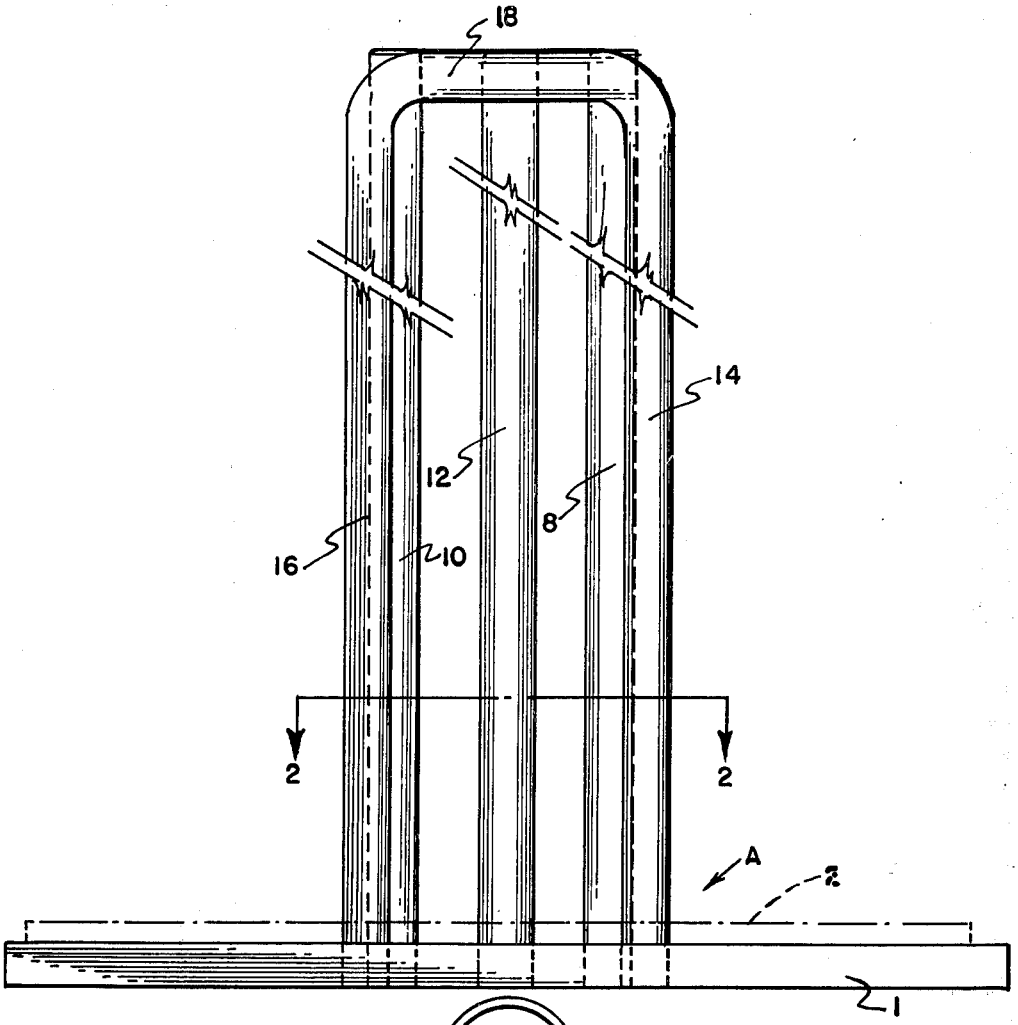
FIG. 1 is a fragmentary view in elevation of the clothes hanger rack.
Figure 2:
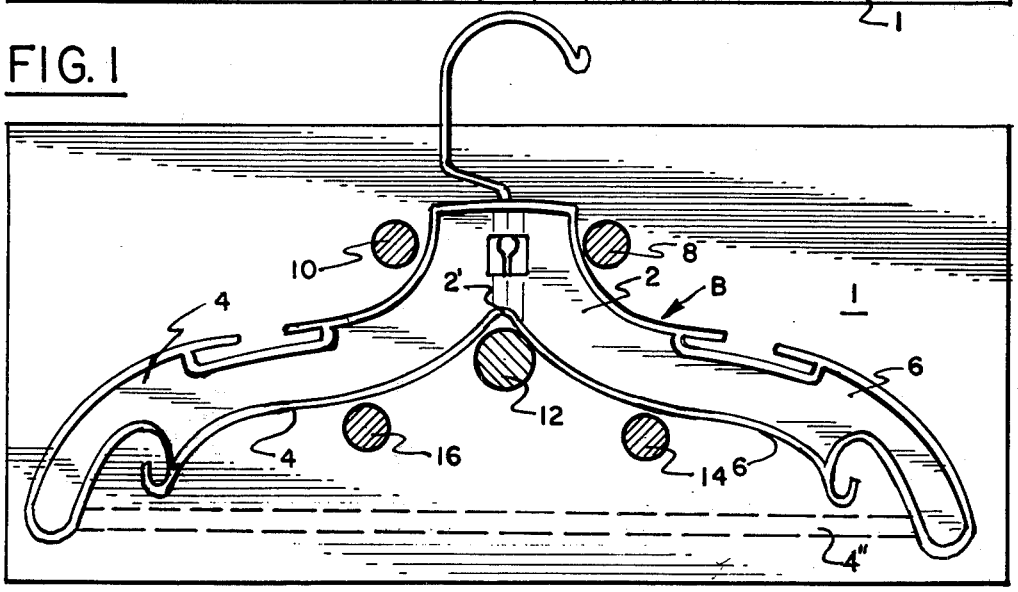
FIG. 2 is a sectional plan view taken on line 2—2 of FIG. 1.

The clothes hanger rack A is provided with a base 1 of any convenient shape adapted to receive a plurality of clothes hangers B in a horizontal position, as shown best in FIG. 2.

The clothes hanger B is formed with a neck section 2 and two shoulder sections 4 and 6.

The base 2 is provided on its upper surface with a plurality of posts, 8, 10, 12, 14 and 16. Two of the posts 8 and 10 are spaced apart adjacent one side of the base and in the same plane, and are adapted to engage the neck portion one on each side thereof. The third post 12 is offset from the plane of the posts 8 and 10 and positioned centrally of the opening between the posts 8 and 10. The posts 14 and 16 are positioned in a plane parallel with the first-mentioned plane and are spaced outwardly from the third post 12 adapted to engage the edges 4′ and 6′ of the hanger.

The posts 14 and 16 are connected at their outer ends as shown at 18 to form a handle for conveniently carrying the rack from place to place and for lifting the rack and depositing it into a container (not shown) for shipping or storing of the hangers.

The post 12 is most important to the present structure in that this post prevents the hangers from shifting to either side of the rack if the style of the hanger is not such as to be in close contact with the posts 14 and 16. The posts 14 and 16 are also spaced away from a plane passing through the outer ends of the shoulder section in case the hanger is provided with a cross piece shown in dotted lines 4″ in FIG. 2.

The rack may be constructed of any suitable material such as plastic, wood, pressed paper or the like, depending upon the material available and the appearance preferred.

If preferred, the post 12 may be adjustable on the base perpendicular relative to the plane passing through posts 8 and 10 should the width of the throat section 2′ of the hanger vary substantially from the hanger illustrated herein.

While a specific form of a clothes hanger rack has been shown, it is not intended to be a limitation as the scope of the invention is best defined in the appended claim.

I claim:

1. In combination, a unitary garment hanger of substantially flat form having a single extended neck portion and a pair of oppositely disposed shoulder portions extending outwardly and downwardly from each side of the neck portion forming a junction with the neck portion and with one another in substantially the same plane, the upper edges of the extended neck portion having a concave surface along each of the two side edges to receive the neck portion of the garment, a base of such dimension as to receive the hanger in a horizontal position, a pair of laterally spaced posts extending upwardly from the upper surface of the base and perpendicular thereto, said posts positioned one on each side of the neck portion of the hanger, a third post extending upwardly from the base parallel with the first two posts and off-set from the plane connecting the two posts in a horizontal central line perpendicular to the center of the plane connecting the first two posts and so positioned on the base as to slideably engage the under edge of the junction of the two shoulder portions, a second pair of laterally spaced posts fixed to the base parallel with the said third post and spaced outwardly therefrom and on the opposite side of the third post from the first two posts, the second pair of posts located in a plane parallel with the plane of the first two posts, each of the second pair of posts being spaced laterally from the center line at a greater distance than the corresponding first post and positioned on the base to slideably engage the bottom edges of the two shoulder portions of the hanger.

* * * * *